US011925836B2

(12) United States Patent
Hu

(10) Patent No.: US 11,925,836 B2
(45) Date of Patent: Mar. 12, 2024

(54) BALANCE BOARD FOR TRAINING AND FITNESS

(71) Applicant: Fang Hu, Yongkang (CN)

(72) Inventor: Fang Hu, Yongkang (CN)

( * ) Notice: Subject to any disclaimer, the term of this patent is extended or adjusted under 35 U.S.C. 154(b) by 0 days.

(21) Appl. No.: 18/140,621

(22) Filed: Apr. 28, 2023

(65) Prior Publication Data

US 2023/0405398 A1 Dec. 21, 2023

(30) Foreign Application Priority Data

Jun. 16, 2022 (CN) ..... 202221519290.7

(51) Int. Cl.
*A63B 22/16* (2006.01)
*A63B 21/00* (2006.01)

(52) U.S. Cl.
CPC ..... *A63B 22/16* (2013.01); *A63B 21/4034* (2015.10); *A63B 2208/0204* (2013.01); *A63B 2209/08* (2013.01)

(58) Field of Classification Search
CPC ..... A63B 22/16; A63B 21/4034; A63B 2208/0204; A63B 2209/08
See application file for complete search history.

(56) References Cited

U.S. PATENT DOCUMENTS 4,826,159 A * 5/1989 Hersey ..... A63B 26/003 482/146
6,916,276 B1 * 7/2005 Robinson ..... A63B 69/0093 482/80
7,300,392 B1 * 11/2007 Curran ..... A63B 22/18 482/146
7,775,952 B1 * 8/2010 Curran ..... A63B 41/00 482/146
9,387,363 B1 * 7/2016 Polinsky ..... A63B 26/003
2007/0027010 A1 * 2/2007 Tsai ..... A63B 21/0004 482/142
2009/0197748 A1 * 8/2009 Smith ..... A63B 22/18 482/146
2013/0123077 A1 * 5/2013 Dunegan ..... A63B 21/0442 482/139
2018/0001143 A1 * 1/2018 Brown ..... A63B 22/16
2020/0094107 A1 * 3/2020 Mrzlak ..... A63B 22/16

* cited by examiner

*Primary Examiner* — Andrew S Lo

(57) ABSTRACT

A balance board for training and fitness that comprises a balance board body, a rolling ball or roller, and an adjusting component; the adjusting component comprises two arc-shaped adjusting parts and two vertical adjusting parts; when in use, the two arc-shaped adjusting parts and the two vertical adjusting parts cooperate to form a first movable space for adapting the rolling ball, the two arc-shaped adjusting parts cooperate to form a second movable space for adapting the rolling ball, and the two vertical adjusting parts cooperate to form a third movable space for adapting the roller. The two arc-shaped adjusting parts and two vertical adjusting parts can be used together or independently to form a plurality of movable spaces with different ranges, so that the swing amplitude of the balance board body can be adjusted to meet users with different training needs.

10 Claims, 7 Drawing Sheets

BALANCE BOARD FOR TRAINING AND FITNESS

TECHNICAL FIELD

The present invention relates to the technical field of balance boards, in particular to a balance board for training and fitness.

BACKGROUND

Balance ability refers to the ability to control one's body center of gravity in a certain spatial range and ensure one's balance when doing any action. Balance ability is a necessary condition to help people complete standing, walking and coordinated movements in daily life, and it is also an important indicator of athletes' sports skills. Balance ability training is an indispensable part of physical training for professional athletes such as gymnastics, taekwondo and skiing.

The existing balance boards are relatively simple in structure, and the moving range of the rolling ball and the roller can not be adjusted when the balance boards are used, so that different balance boards need to be selected according to the training requirements in the training process, and a plurality of balance boards occupy a large storage space, which is not conducive to the storage of users, and also leads to the prolonged cleaning time of the balance boards by users.

SUMMARY

In view of the shortcomings in the above problems, the present invention provides a balance board for training and fitness.

In order to achieve the above purpose, the present invention provides a balance board for training and fitness, which includes a balance board body, a rolling ball or roller which is matched with the balance board body for training and fitness and is separately connected with the balance board body, and an adjusting component which is detachably connected to one end of the balance board body and used for adjusting the moving range of the rolling ball or roller; the adjusting component comprises two arc-shaped adjusting parts and two vertical adjusting parts; when in use, the two arc-shaped adjusting parts and the two vertical adjusting parts cooperate to form a first movable space for adapting the rolling ball, the two arc-shaped adjusting parts cooperate to form a second movable space for adapting the rolling ball, and the two vertical adjusting parts cooperate to form a third movable space for adapting the roller. The balance board body comprises a pedal surface used by a user, and a rolling surface matched with a rolling ball and a roller; when in use, the rolling surface of the balance board body is placed on the rolling ball or roller, and the user stands on the pedal surface of the balance board body for manipulation and balance force training; the pedal surface includes pedal parts which are close to the two inclined ends when the pedal surface is used, and generally, when the pedal surface is used, the user's feet are placed on the two pedal parts for training and fitness; the vertical adjusting part can be a telescopic structure, and different movable spaces for adapting the rolling ball can be formed by adjusting the length of the vertical adjusting part and the arc adjusting part.

The cooperation or independent use of the two arc-shaped adjusting parts and the two vertical adjusting parts can form a plurality of movable spaces with different ranges, so that the swinging amplitude of the balance board body can be adjusted to meet users with different training needs, which is convenient for users to use and reduces cost consumption and cleaning time.

Further, one end of the arc-shaped adjusting part extends outwards to form a plurality of first positioning posts, and correspondingly, the balance board body is provided with a plurality of first positioning holes for adapting to each first positioning post;

in the technical solution, by the cooperation of the first positioning post and the first positioning hole, the arc-shaped adjusting part can be fixedly connected on the balance board body, so that the arc-shaped adjusting part can not be separated from the balance board body; by symmetrically arranging a plurality of groups of first positioning posts on each arc-shaped adjusting part, a plurality of groups of first positioning holes arranged along the length direction of the balance board body are symmetrically arranged; a vertical adjusting plate can be fitted in any group of first positioning holes to adjust different moving ranges for adapting the roller.

Further, the end of the first positioning post far away from the arc-shaped adjusting part is provided with a first magnetic attraction part, and correspondingly, the end of the balance board body far away from the arc-shaped adjusting part is provided with a second magnetic attraction part for sealing the first positioning hole and magnetically connected with the first magnetic attraction part;

in the technical solution, through the cooperation of the first magnetic attraction part and the second magnetic attraction part, the fixing degree of the arc-shaped adjusting part on the balance board body can be further improved.

Further, an end of the vertical adjusting part extends outwards to form a plurality of second positioning posts, and correspondingly, the balance board body is provided with a plurality of second positioning holes for adapting to each second positioning post;

in the technical solution, through the cooperation of the second positioning post and the second positioning hole, the vertical adjusting part can be fixedly connected to the balance board body, so that the vertical adjusting part can not be separated from the balance board body.

Further, an end of the second positioning post far from the vertical adjusting part is provided with a third magnetic attraction part, and correspondingly, an end of the balance board body far from the vertical adjusting part is provided with a fourth magnetic attraction part for sealing the second positioning hole and magnetically connecting with the third magnetic attraction part;

in the technical solution, through the cooperation of the third magnetic attraction part and the fourth magnetic attraction part, the fixing degree of the vertical adjusting part on the balance board body can be further improved.

Further, the vertical adjusting part is sequentially provided with two second positioning posts along a length direction thereof, and correspondingly, the balance board main body is provided with two groups of transversely arranged second positioning holes and two groups of longitudinally arranged second positioning holes;

In the technical solution, the two second positioning posts are matched with the two second positioning holes arranged horizontally or vertically, so that the vertical adjusting part can be fixedly connected on the balance board body, and at the same time, a third movable space is formed or a first movable space is formed together with the arc adjusting part.

Further, the two arc-shaped adjusting parts are assembled in the first positioning hole, and the two vertical adjusting parts are assembled in the second positioning hole which is arranged horizontally, and then cooperate to form the first movable space; two ends of the two vertical adjusting parts respectively contact two ends of the two arc adjusting parts which are close to each other; the two arc-shaped adjusting parts are assembled in the first positioning hole and then matched to form the second movable space; two ends of the two arc-shaped adjusting parts which are close to each other are in contact with each other; the two vertical adjusting parts are assembled in the second positioning holes longitudinally arranged and then matched to form the third movable space;

in the technical solution, two arc-shaped adjusting parts can form a second movable space, and two arc-shaped adjusting parts are combined with two vertical adjusting parts to form the first movable space.

Further, both ends of the arc-shaped adjusting part are provided with concave parts which are concave inwards, and correspondingly, both ends of the vertical adjusting part are provided with convex parts which are matched with the concave parts;

in the technical solution, when the two arc-shaped adjusting parts and the two vertical adjusting parts are used together, the contact tightness between the arc-shaped adjusting parts and the vertical adjusting parts can be improved after the convex parts are adapted to the concave parts.

Further, the side wall of the arc-shaped adjusting part is provided with anti-skid protrusions, which is convenient for taking the arc-shaped adjusting part off the balance board body; The side walls of the two ends of the vertical adjusting part are located at the central part, and both of them are recessed inward to form recessed areas;

in the technical solution, it is convenient to take down the vertical adjusting part from the balance board body.

Further, both ends of the balance board body which are inclined when in use are provided with buffer parts;

in the technical solution, the arrangement of the buffer parting part can improve the friction between the board body and the ground when in use, and is safer.

Compared with the prior art, the present invention has the beneficial effects that: the present invention relates to a balance board for training and fitness, and the matching or independent use of two arc-shaped adjusting parts and two vertical adjusting parts can form a plurality of movable spaces with different ranges, so that the swinging amplitude of the balance board body can be adjusted to meet users with different training needs, which is convenient for users to use and reduces cost consumption and cleaning time.

Description of reference signs: 1, Balance board body; 11, First positioning hole; 12, Second magnetic attraction part; 13, Second positioning hole; 14, Fourth magnetic attraction part; 15, Buffer part; 16, Pedal surface; 161, Pedal part; 162, First groove; 163, Second groove; 17, Rolling surface; 2, Rolling ball; 3, Roller; 4, Arc-shaped adjusting part; 41, First positioning post; 411, First magnetic attraction part; 42, Recessed part; 43, Anti-skid protrusion; 5, Vertical adjusting part; 51, Second positioning post; 511, Third magnetic attraction part; 52, Convex part; 53, Recessed area; 6, First movable space; 7, Second movable space; 8, Third movable space.

DESCRIPTION OF EMBODIMENTS

Figure 1:
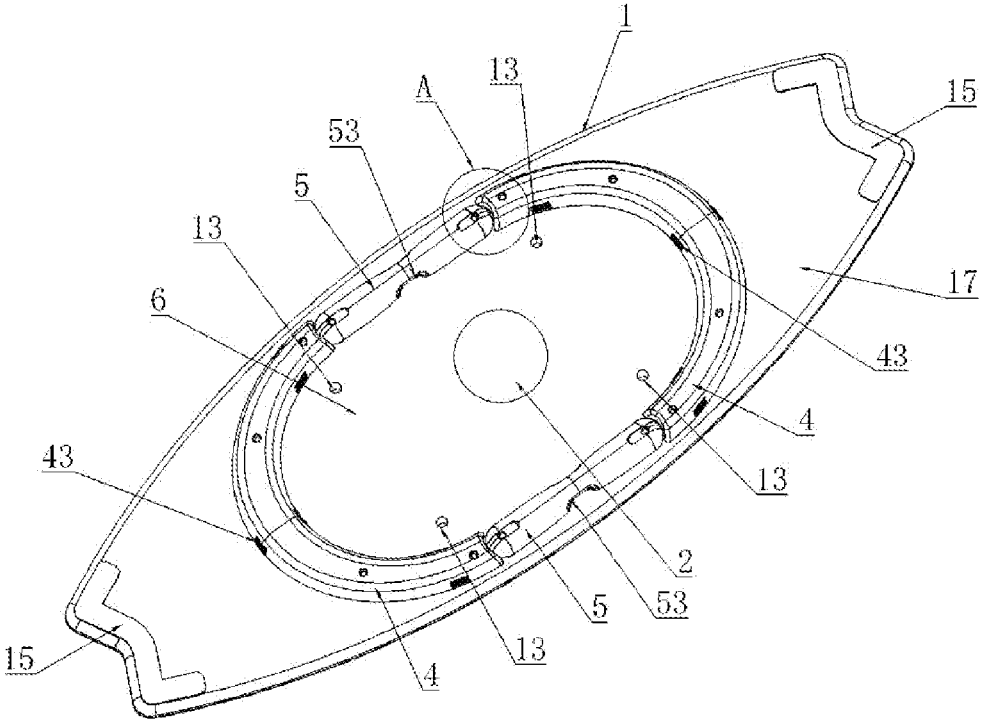
FIG. 1 is a schematic diagram of a balance board for training and fitness in this embodiment (reflecting a first movable space)
Figure 2:
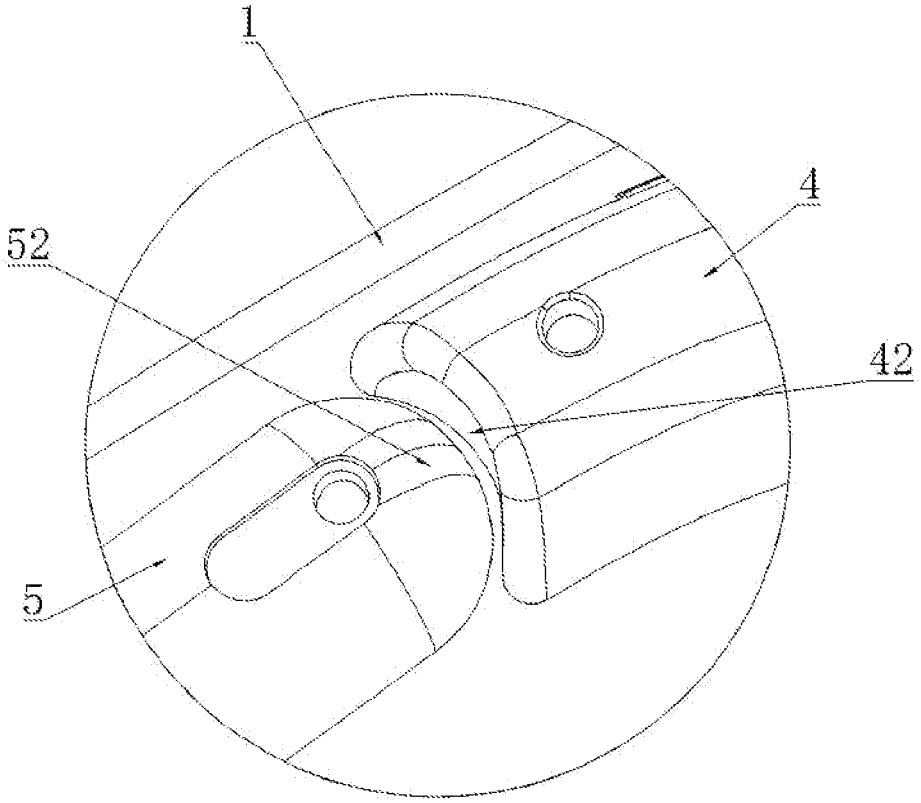
FIG. 2 is an enlarged schematic view at a in FIG. 1.
Figure 3:
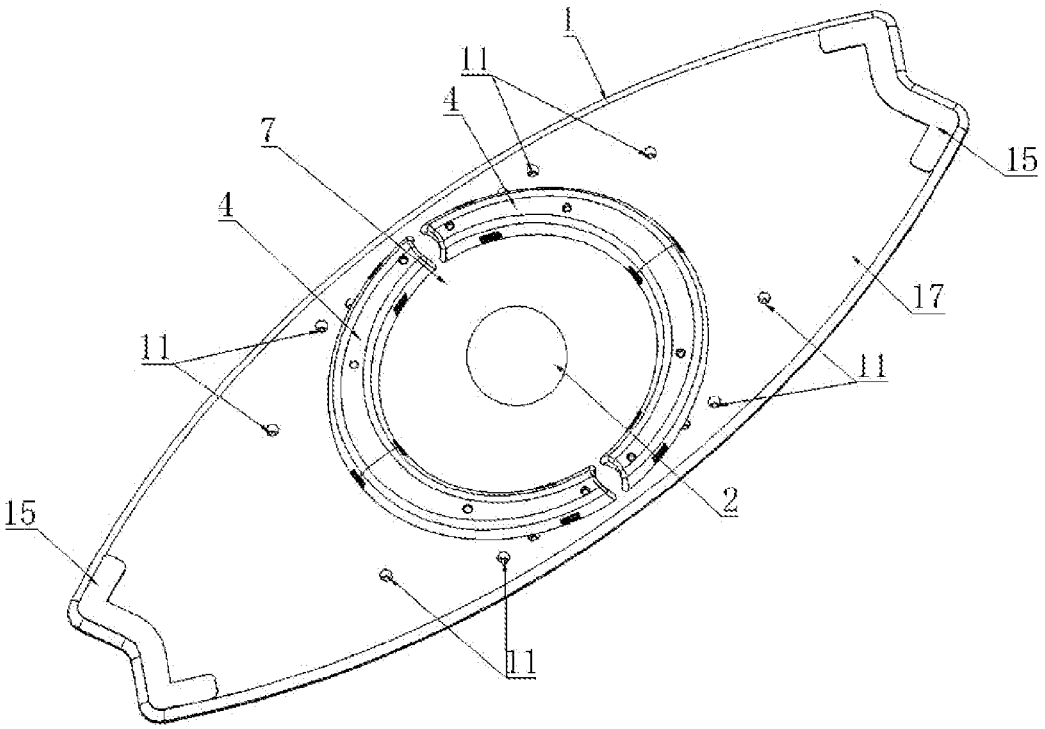
FIG. 3 is a schematic diagram of a balance board for training and fitness in this embodiment (reflecting the second movable space)
Figure 4:
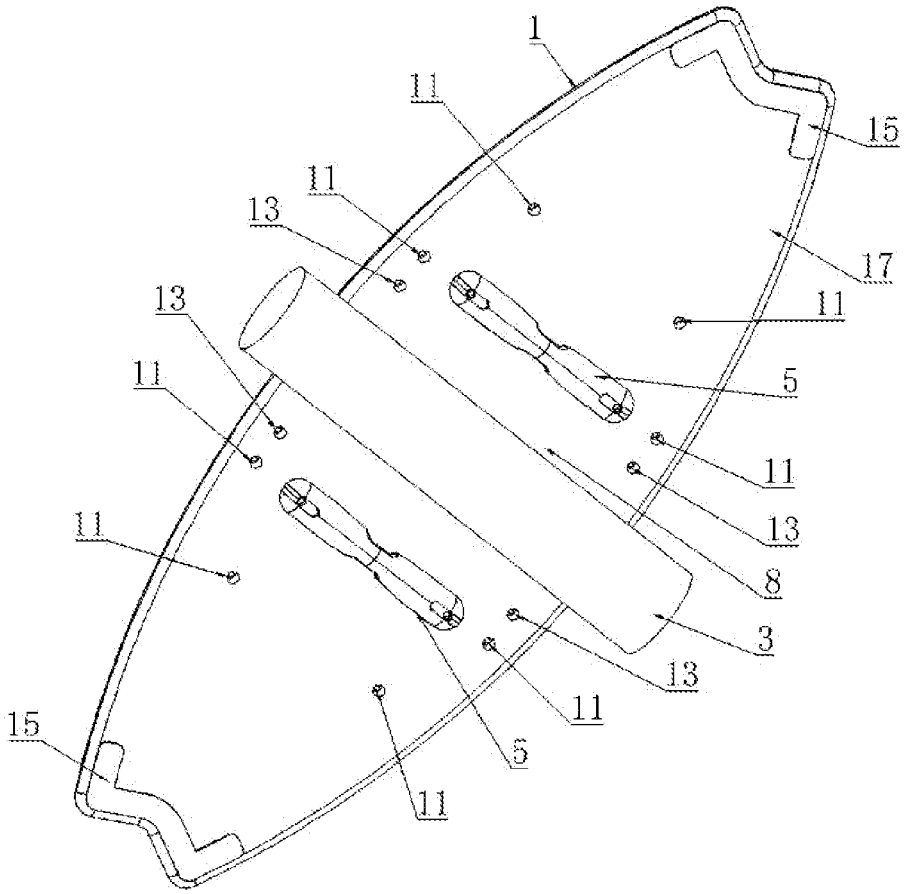
FIG. 4 is a schematic diagram of a balance board for training and fitness in this embodiment (reflecting the third movable space)
Figure 5:
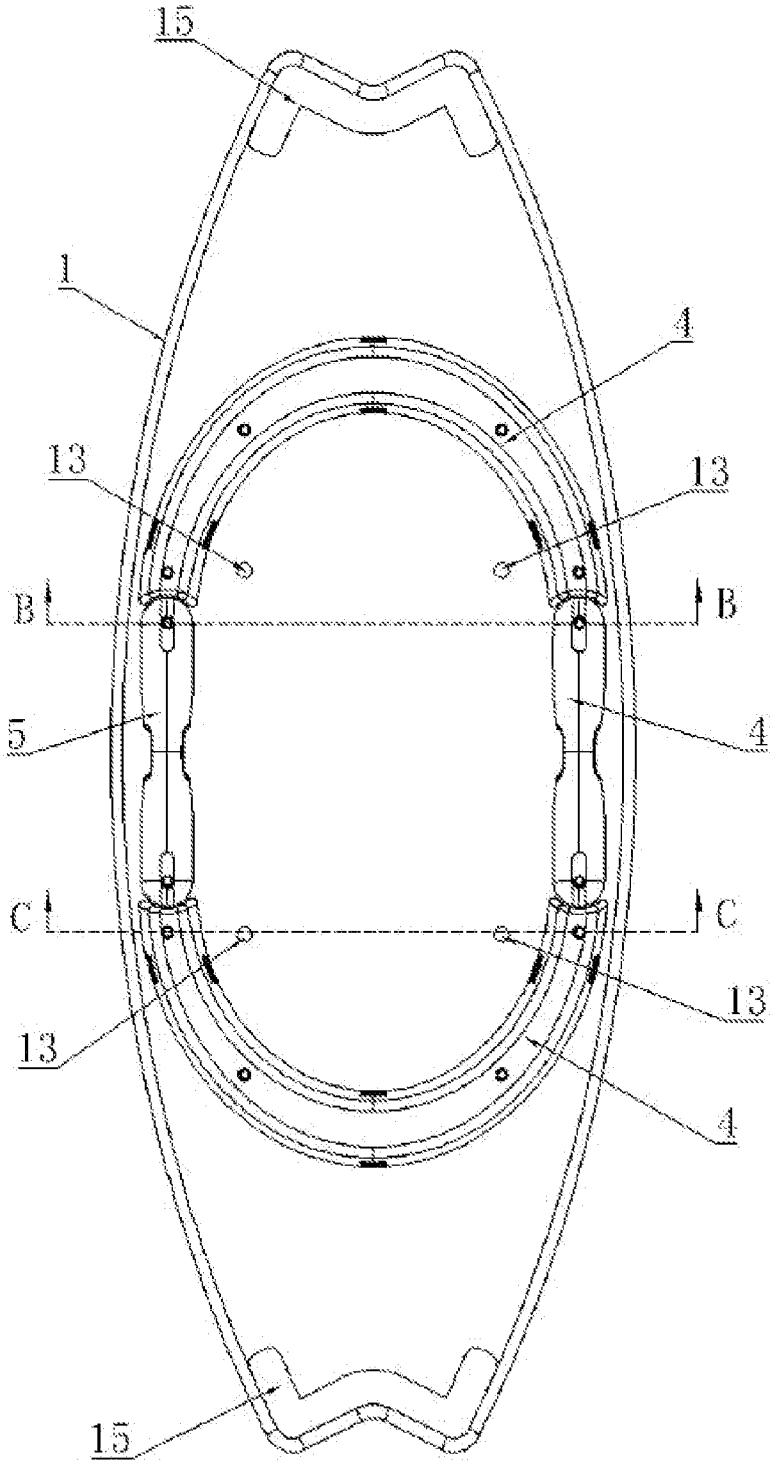
FIG. 5 is a schematic diagram of a balance board for training and fitness in this embodiment.
Figure 6:
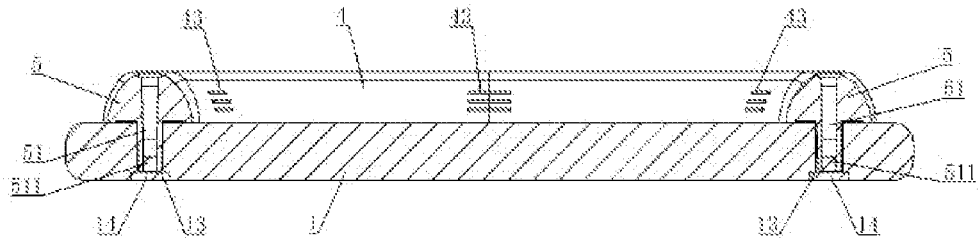
FIG. 6 is a sectional view taken at B-B in FIG. 5.
Figure 7:
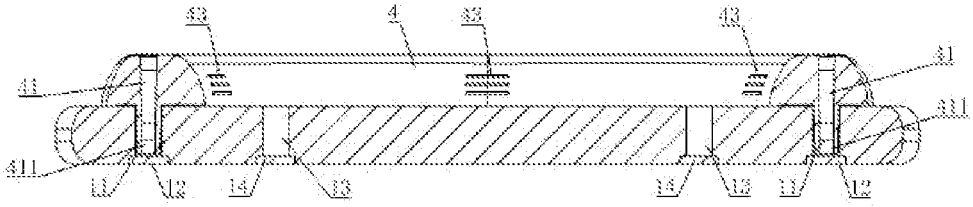
FIG. 7 is a sectional view taken at C-C in FIG. 5.
Figure 8:
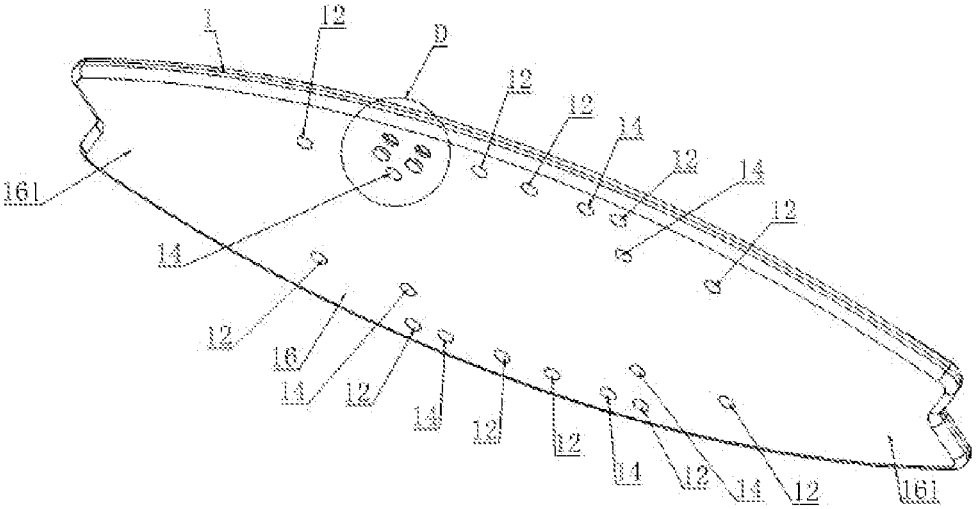
FIG. 8 is a partial explosion schematic diagram of the balance board body of this embodiment.
Figure 9:
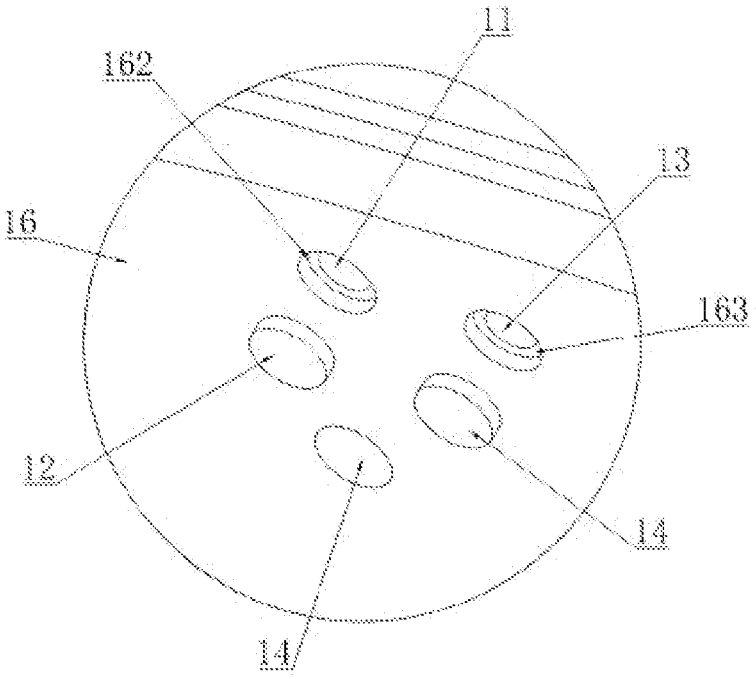
FIG. 9 is an enlarged schematic view at d in FIG. 8.

As shown in FIGS. 1-9, a balance board for training and fitness in this embodiment includes a balance board body 1, a rolling ball 2 or a roller 3 which is matched with the balance board body 1 for training and fitness and is separately connected with the balance board body 1, and an adjusting component which is detachably connected to one end of the balance board body 1 and used for adjusting a moving range of the rolling ball 2 or roller 3; wherein the adjusting component comprises two arc-shaped adjusting parts 4 and two vertical adjusting parts 5 in a vertical shape; when in use, the two arc-shaped adjusting parts 4 and the two vertical adjusting parts 5 cooperate to form a first movable space 6 for adapting the rolling ball 2, the two arc-shaped adjusting parts 4 cooperate to form a second movable space 7 for adapting the rolling ball 2, the two vertical adjusting parts 5 cooperate to form a second movable space 7 for adapting the rolling ball 2, and the two vertical adjusting parts 5 cooperate to form a third movable space 8 for adapting the roller 3. Preferably, the balance board body 1 includes a pedal surface 16 for a user to pedal, and a rolling surface 17 for cooperating with the rolling ball 2 and the roller 3; when in use, the rolling surface 17 of the balance board body 1 is placed on the rolling ball 2 or the roller 3, and the user stands on the pedal surface 16 of the balance board body 1 for manipulation and balance training; the pedal surface 16 includes pedal parts 161 close to the two inclined ends when it is used. Usually, when it is used, the user's feet are placed on the two pedal parts 161 for training and fitness. By adopting the above solution, two arc-shaped adjusting parts 4 and two vertical adjusting parts 5 can be used together or independently to form a plurality of movable spaces with different ranges, so that the swing amplitude of the balance board body 1 can be adjusted to meet users with different training needs, which is convenient for users to use and reduces cost consumption and cleaning time.

Further, one end of each arc-shaped adjusting part 4 extends outward to form four first positioning posts 41 arranged along its arc shape, and correspondingly, the balance board body 1 is provided with six first positioning holes 11 for adapting to the first positioning posts 41 of each arc-shaped adjusting part; through the cooperation of the first positioning post 41 and the first positioning hole 11, the arc-shaped adjusting part 4 can be fixedly connected to the balance board body 1, so that the arc-shaped adjusting part 4 will not be separated from the balance board body 1. When the four first positioning holes 11 are adapted to the first positioning post 41, the arc-shaped adjusting part 4 and the vertical adjusting part 5 are in a state of cooperating with each other. When the other two first positioning holes 11 are adapted to the first positioning posts 41 at both ends of the arc-shaped adjusting part 4, the arc-shaped adjusting part 4 is used alone. Further, the end of the first positioning post 41 far away from the arc-shaped adjusting part 4 is provided with a first magnetic attraction part 411, and correspondingly, the end of the balance board body 1 far away from the arc-shaped adjusting part 4 is provided with a second magnetic attraction part 12 for sealing the first positioning hole 11 and magnetically connecting with the first magnetic attraction part 411; through the cooperation of the first magnetic attraction part 411 and the second magnetic attraction part 12, the fixing degree of the arc-shaped regulator 4 on the balance board body 1 can be further improved. Preferably, the pedal surface 16 of the balance board body 1 is provided with a first groove 162 for fitting the second magnetic attraction part 12, and the axial diameter of the first groove 162 is larger than that of the first positioning hole 11; after the second magnetic attraction part 12 is assembled in the first groove 162, its end close to the pedal surface 16 is flush with the pedal surface 16. Further, the vertical adjusting part 5 is sequentially provided with two second positioning posts 51 along its length direction, and correspondingly, the balance board body is provided with two groups of second positioning holes 13 arranged horizontally and two groups of second positioning holes 13 arranged longitudinally; through the cooperation of the second positioning post 51 and the second positioning hole 13, the vertical adjusting part 5 can be fixedly connected to the balance board body 1, so that the vertical adjusting part 5 will not be separated from the balance board body 1. Further, the end of the second positioning post 51 far away from the vertical adjusting part 5 is provided with a third magnetic attraction part 511, and correspondingly, the end of the balance board body 1 far away from the vertical adjusting part 5 is provided with a fourth magnetic attraction part 14 for sealing the second positioning hole 13 and magnetically connecting with the third magnetic attraction part 511; through the cooperation of the third magnetic attraction part 511 and the fourth magnetic attraction part 14, the fixing degree of the vertical regulator 5 on the balance board body 1 can be further improved. Preferably, the pedal surface 16 of the balance board body 1 is provided with a second groove 163 for fitting the fourth magnetic attraction part 14, and the axial diameter of the second groove 163 is larger than that of the second positioning hole 13; after the fourth magnetic attraction part 14 is assembled in the second groove 163, its end close to the pedal surface 16 is flush with the pedal surface 16.

Further, the two arc-shaped adjusting parts 4 are assembled in the first positioning hole 11, and the two vertical adjusting parts 5 are assembled in the second positioning hole 13 arranged horizontally to form the first movable space 6. Two ends of the two vertical adjusting parts 5 respectively contact two ends of the two arc adjusting parts 4 which are close to each other; two arc-shaped adjusting parts 4 are assembled in the first positioning hole 11 and then cooperate to form a second movable space 7; two ends of the two arc-shaped adjusting parts 4 which are close to each other are in contact with each other; the two vertical adjusting parts 5 are assembled in the longitudinally arranged second positioning holes 13 and then cooperate to form the third movable space 8. Further, both ends of the arc-shaped adjusting part 4 are provided with concave parts 42 which are recessed inward, and correspondingly, both ends of the vertical adjusting part 5 are provided with convex parts 52 which are adapted to the concave parts. Specifically, when two arc-shaped adjusting parts 4 and two vertical adjusting parts 5 are used together, the contact tightness between the arc-shaped adjusting parts 4 and the vertical adjusting parts 5 can be improved after the convex part 52 is adapted to the concave part 42.

Further, the side wall of the arc-shaped adjusting part 4 is provided with anti-slip protrusions 43, which is convenient for taking the arc-shaped adjusting part 4 off the balance board body 1; the side walls of both ends of the vertical adjusting part 5 are located at the central part, and are both inwardly recessed to form recessed areas 53, which is convenient for taking the vertical adjusting part 5 off the balance board body 1. Furthermore, both ends of the balance board body 1 which are inclined when in use are provided with buffer parts 15, and the arrangement of the buffer parts 15 can improve the friction between the balance board body 1 and the ground when in use, which is safer.

The present invention relates to a balance board for training and fitness, wherein two arc-shaped adjusting parts and two vertical adjusting parts can be used together or independently to form a plurality of movable spaces with different ranges, so that the swinging amplitude of the balance board body can be adjusted to meet users with different training needs, which is convenient for users to use and reduces cost consumption and cleaning time.

What has been described above is only the preferred embodiment of the present invention, and it is not used to limit the present invention. For those skilled in the art, the present invention may have various modifications and changes. Any modification, equivalent substitution, improvement and the like made within the spirit and principle of the present invention shall be included in the protection scope of the present invention.

What is claimed is:

1. A balance board for training and fitness, comprising a balance board body, a rolling ball or a roller which is matched with the balance board body for training and fitness and is separately connected with the balance board body, and an adjusting component which is detachably connected to a surface of the balance board body and used for adjusting a moving range of the rolling ball or roller; wherein the adjusting component comprises two arc-shaped adjusting parts and two vertical adjusting parts in a vertical shape; when in use, the two arc-shaped adjusting parts are coupled to the two vertical adjusting parts on the surface of the balance board body to form a first movable space for adapting the rolling ball, the two arc-shaped adjusting parts are coupled to each other on the surface of the balance board body to form a second movable space for adapting the rolling ball, and the two vertical adjusting parts are spaced and longitudinally coupled on the surface of the balance board body to form a third movable space for adapting the roller.

2. The balance board for training and fitness according to claim 1, wherein a plurality of first positioning posts is formed at one end of each of the two arc-shaped adjusting parts extending outwards, and correspondingly, the balance board body is provided with a plurality of first positioning holes adapted to each of the plurality of first positioning posts.

3. The balance board for training and fitness according to claim 2, wherein an end of each of the plurality of first positioning posts of each of the two arc-shaped adjusting part is provided with a first magnetic attraction part, and correspondingly, an end of the balance board body is provided with a second magnetic attraction part for sealing the plurality of first positioning holes and magnetically connecting with the first magnetic attraction part.

4. The balance board for training and fitness according to claim 2, wherein each end of the two vertical adjusting parts extends outwards to form a plurality of second positioning posts, and correspondingly, the balance board body is provided with a plurality of second positioning holes adapted to each of the second positioning posts.

5. The balance board for training and fitness according to claim 4, wherein an end of each of the second positioning posts of each of the two vertical adjusting parts is provided with a third magnetic attraction part, and correspondingly, an end of the balance board body is provided with a third magnetic attraction part for sealing the plurality of second positioning holes and connecting with the plurality of second positioning holes.

6. The balance board for training and fitness according to claim 4, wherein the vertical adjusting part is provided with two second positioning posts in sequence along a length direction thereof, and correspondingly, the balance board body is provided with two groups of horizontally arranged second positioning holes and two groups of longitudinally arranged second positioning holes.

7. The balance board for training and fitness according to claim 6, wherein the two arc-shaped adjusting parts are assembled in the first positioning hole, and the two vertical adjusting parts are assembled in the second positioning hole arranged horizontally, and then cooperate to form the first movable space; wherein, two ends of the two vertical adjusting parts respectively contact two adjacent ends of the two arc adjusting parts; the two arc-shaped adjusting parts are assembled in the first positioning hole and then matched to form the second movable space; wherein two adjacent ends of the two arc-shaped adjusting parts are in contact with each other; the two vertical adjusting parts are assembled in second positioning holes longitudinally arranged and then cooperate to form the third movable space.

8. The balance board for training and fitness according to claim 7, wherein both ends of the two arc-shaped adjusting parts are provided with concave parts which are recessed inward, and correspondingly, both ends of the two vertical adjusting parts are provided with convex parts which are adapted to the concave parts.

9. The balance board for training and fitness according to claim 1, wherein each of a side wall of the two arc-shaped adjusting parts is provided with anti-skid protrusions, and side walls of both ends of the vertical adjusting part are located at a central part and are both inwardly recessed to form recessed areas.

10. The balance board for training and fitness according to claim 1, wherein the surface of the balance board body which are inclined during use are provided with a buffer part at both ends.

* * * * *